United States Patent [19]

White

[11] Patent Number: 4,780,920

[45] Date of Patent: Nov. 1, 1988

[54] ANGULAR SLEEPER'S PILLOW AND PILLOWCASE

[76] Inventor: Aaron L. White, 23300 Providence Dr., Suite 510, Southfield, Mich. 48075

[21] Appl. No.: 90,844

[22] Filed: Aug. 28, 1987

[51] Int. Cl.[4] ..... A47G 9/00

[52] U.S. Cl. ..... 5/436; 5/490

[58] Field of Search ..... 5/434–437, 5/441, 442, 490; D6/601

[56] References Cited

U.S. PATENT DOCUMENTS

| | | | |
|---|---|---|---|
| D. 258,793 | 4/1981 | Rinz | D6/601 |
| 1,386,652 | 8/1921 | Patton | 5/437 |
| 1,787,832 | 1/1931 | Mueller | 5/434 |

FOREIGN PATENT DOCUMENTS

| | | | |
|---|---|---|---|
| 820810 | 8/1937 | France | 5/436 |
| 1049523 | 12/1953 | France | 5/436 |
| 93641 | 12/1938 | Sweden | 5/436 |
| 253404 | 6/1926 | United Kingdom | 5/485 |
| 1048632 | 11/1966 | United Kingdom | 5/436 |

*Primary Examiner*—Alexander Grosz

*Attorney, Agent, or Firm*—Brooks & Kushman

[57] ABSTRACT

A side sleeper's pillow and case therefor both include a generally rectangular main pillow portion and an extension pillow portion depending from the lower edge of the main pillow portion adjacent one side edge thereof having a transition side edge connecting the lower edge of the main pillow portion to the lower edge of the extension pillow portion. The transition side edge of the extension pillow forms an obtuse angle. The side sleeper's pillow may be utilized in pairs with a single pillow case open at the ends and sewn together centrally, which pillow case receives single side sleeper's pillows in the opposite ends thereof. Further, the side sleeper's pillow may be made in various sizes to complement different sized beds, and may be made in a particularly small size as a travel pillow.

6 Claims, 2 Drawing Sheets

ANGULAR SLEEPER'S PILLOW AND PILLOWCASE

TECHNICAL FIELD

The invention relates to pillows and cases for pillows, and specifically refers to a pillow and case for a yellow particularly constructed to support the head of an individual sleeping or resting on either side and assuming varying degrees of a fetal position: a resting position in which the body is curved, having the legs and arms bent and drawn toward the chest, and the head bowed forward.

BACKGROUND ART

Prior pillow structure, particularly of the "L" shaped pillows and the rectangular pillows are not constructed with an obtuse angle to provide a specific area that is required to give special support to the head of the average side sleeping individual when in the fetal position and when the head is bowed to a forward position along an axis defined by the flexing of the neck. With the usual rectangular pillows of the past, side sleepers having a tendency to rotate their heads forward as they increasingly move into the fetal position so that the side facial area of the head moves off the pillow's bottom edge. This can facilitate an involuntary forward and downward movement of the head, causing the head to roll partly off the pillow and turn downward so that the chin, nose and one cheek rests on the mattress while the back of the head remains elevated by the pillow. This will result in a twist in the neck. Although this position may not be immediately painful or awaken the sleeper, the twist can cause stress on the neck which may produce pain later.

The U.S. Pat. No. 1,386,652 to Patton discloses a pillow having recesses in the longitudinal sides to retain other removable cushions and the provisions to attach the cushions to the main pillow or together to form another pillow. A 10.0 inch radius is the minimum size radius that is large enough to avoid contact with the shoulders while supporting the head. Although a pillow with this radius complies with the teachings of the patent, the radius is unacceptable, being much too small. As the pillow is placed high, at the base of the skull, body movement could cause the pillow to be positioned much lower. The 10.0 radius will then cause the pillow to contact and possibly raise the shoulders. This would be in contradiction to the teachings of the Patton patent. A 20.0 inch radius is the minimum radius suggested for the Patton pillow. This radius is large enough so that when the pillow is at the lower and more proper position behind the head, it does not contact the shoulders. Also, in this lower position, the radius will permit the pillow to have a 0.75 inch clearance with the shoulders. This is allowed to accommodate the larger than average size person without compromising the integrity of the pillow. This radius will also permit the pillow to respond to some body movements without contradicting the teachings of the patent. Therefore, the 20.0 inch radius is the minimum size to meet the criterion of the Patton pillow and not contacting the shoulders when placed behind the head and having the recesses to contain other removable pillow parts. The curvature of the 20.00 inch radius, however, is not nearly sufficient to resemble the contour of the human figure's shoulder.

Also, this radius will not allow the Patton pillow to provide the support to the head at the lower jaw.

DISCLOSURE OF THE INVENTION

In accordance with the present invention, a side sleeper's pillow is provided which includes extending the width of the pillow at one end of the bottom edge, having the extended portion's bottom edge also parallel to the opposite edge and an obtuse angle in the transition between the two widths. The angular extension of the pillow, thus provided, facilitates the forward curved body movement, supports the side sleeper's head as it is bowed forward and helps to maintain the proper alignment of the spinal column to thereby practically eliminate the possibility of stressful twisting of the neck as the side sleeper begins to assume the fetal position.

Preferably, the extension portion of the side sleeper's pillow is provided with an obtuse angle and two circular segments at the bottom edge of the main pillow portion.

Further, the side sleeper's pillow, in accordance with the invention, includes a pillow case having the same contour as the pillow. Furthermore, two such pillow cases may be secured together at like ends and provided with other ends having openings for receiving the side sleeper's pillows. Also, the side sleeper's pillow, in accordance with the invention, includes any other covering (i.e. bed linen) having the same contour as two pillows with like ends positioned together.

BEST MODE FOR CARRYING OUT THE INVENTION

Figure 1:
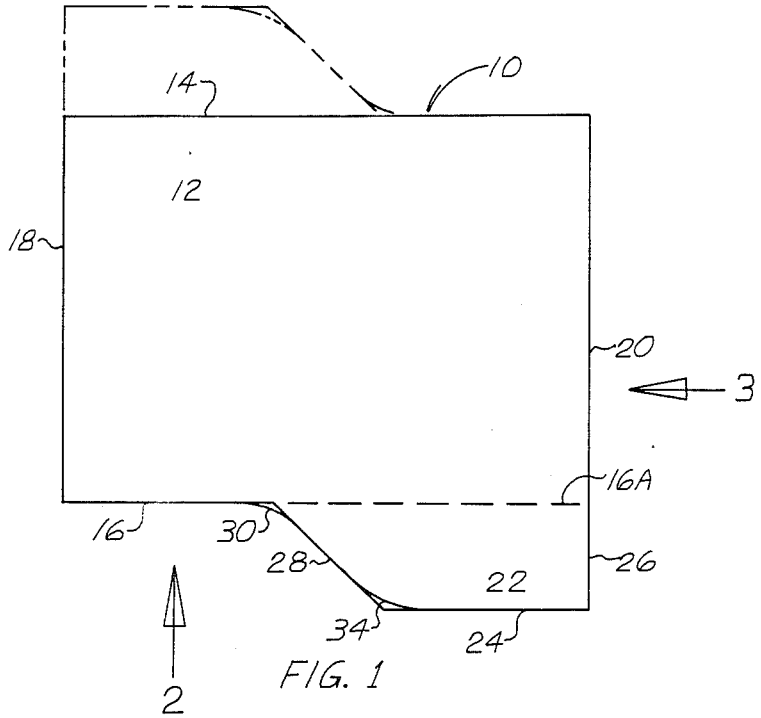
FIG. 1 is a top or plan view of the side sleeper's pillow of the invention with optional construction at the top of the pillow indicated by phantom lines.
Figure 2:
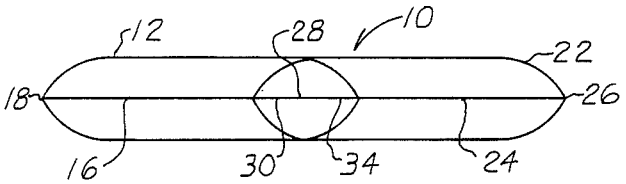
FIG. 2 is an elevational view of the side sleeper's pillow shown in FIG. 1 without the optional construction, taken in the direct of arrow 2 in FIG. 1.
Figure 3:
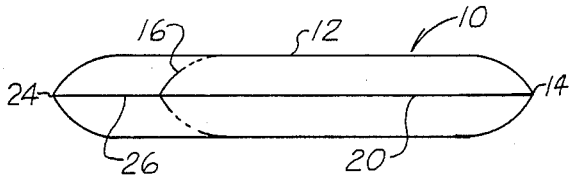
FIG. 3 is an elevational view of the side sleeper's pillow shown in FIG. 3 without the optional construction, taken substantially in the direction of arrow 3 in FIG. 1.

As best shown on FIG. 1, the side sleeper's pillow 10 includes a main pillow portion 12 which is generally rectangular in plan view and includes a parallel, spaced apart, upper edge 14 and a lower edge 16. The upper and lower edges of the main pillow portion 12 are separated by the parallel, spaced apart, side edges 18 and 20.

In accordance with the invention, an extension portion 22 is provided on the pillow 10 extending from the lower edge 16 of the main pillow portion 12 adjacent the side edge 20. The extension portion 22 of the pillow 10 includes a lower edge 24 and side edges 26 and 28.

The side edge 28 of the extension portion 22 of the pillow 10 consists of a transition side edge which joins two arcuate portions, as best shown in FIG. 1, and merges gradually into the lower edge 16 of the main portion 12 of the pillow 10 at one edge, and merges into the lower edge 24 of the extension portion 22 of the pillow 10 at the other end thereof. More specifically, end section 30 of the edge 28 of the extension portion 22 of the pillow 10 is a circular segment which has a radius R1. The other end section 34 of the edge 28 as shown in FIG. 1 is also a circular segment which has a radius R2.

Figure 4:
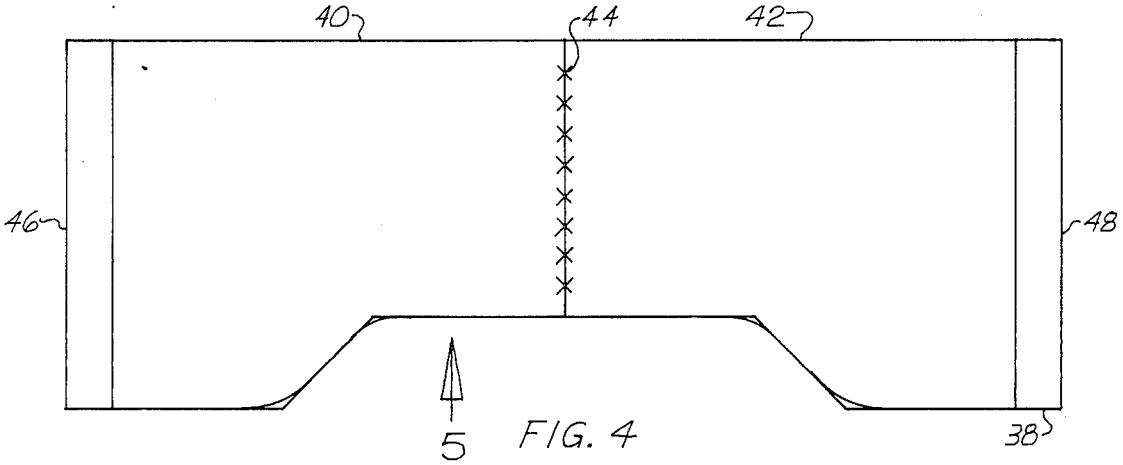
FIG. 4 is a plan view of two side sleeper's pillows as shown in FIG. 1 without the optional construction, positioned in pillow cases contoured to fit the two side sleeper's pillows arranged as shown, which pillow cases are secured together at one end and are open at the other end to receive the side sleeper's pillows.

Referring now to FIG. 4 in combination with FIG. 1, the length of upper edge 14 will range from 12.0 inches for an "easy chair" pillow or travel pillow to 80.0 inches, the width of a "king size" bed. The extension 22 will range in length from 1.0 inch to 20.0 inches as consumers demand or preferably as follows: for the "full size" (FS) bed pillow and pillows smaller, 1.0 to 6.0 inches; "queen size" (QS) bed pillows, 6.0 to 12.0 inches; and, the "king size" (KS) bed pillow, 12.0 to 20.0 inches.

The angle A1 between edges 16 and 28 is an obtuse angle, ranging from 95 degrees to 175 degrees to accommodate the various extents of the fetal position that respective side sleepers assume. The angle will be controlled by the separate length of edges 16, 24, 14 and 26, as consumers require. The length of 14 must be longer than the total length of edges 16 and 24 so that the angle of edge 28 is not less than 95 degrees to edge 16 and not more than 175 degrees to edge 16. Whatever the lengths of edges 16, 24 and 14, the length of edge 26 must be so that the angle of edge 28 is not less than 95 degrees to edge 16 and not more than 175 degrees to edge 16.

Radius R1 ranges from 1.0 inch to 10.0 inches. The 1 inch minimum radius will eliminate a gathering of fabric at the origin of the angle. The radius range to 10.0 inches will allow the pillow to conform snugly to shoulder sizes from that of a little child to that of an extremely obese adult, especially when the angle A1 is closer to the 95 degrees minimum. The wider the angle, the freedom of body movement is greater. Therefore, the wider the angle A1 becomes, the smaller the radius R1 required.

Radius R2 ranges up to 12.0 inches. In general, especially for pillows with the maximum 20.0 inch extension for edge 26 and the minimum 95 degree angle of edge 28, when the side sleeper's shoulder or chest comes in contact with these particular parts of the body, the smoothness of the maximum 12.0 inch radius for R2 will not rub and cause discomfort as a corner of the prior art would. Also, should the side sleeper roll over onto his/her back where the shoulder will push against the pillow, with the maximum 12.0 inch radius for R2, the pillow will not create a resistance to the shoulder movements and thereby minimizes the chances of becoming trapped between the back of the shoulder and the bed and cause discomfort as would the corresponding corner of a pillow of the prior art. The wider the angle A1 becomes, the side 28 will be more in accord with the forward movements of the side sleeper, therefore, the smaller the radius for R2 required. Because this radius is a stitched seam, is made slightly rigid by the density of the fiberfill stuffing, and the pillow 10 is covered by a pillowcase which creates a double seam thickness to make the seam more pronounced, this radius is important to the comfort of the side sleeper.

When the combined lengths of radii R1 and R2 exceed the length of 26, the two radii must have a common tangent point on 28.

Optionally, the same construction may also be applied to the top of a pillow, as illustrated by phantom lines in FIGS. 1 and 4.

In general, the obtuse angle of the transition segment in the extended pillow portion is an approximate parallel to the angle of the lower jaw when the side sleeper's head is bowed forward in a comfortable sleeping position and also provides an easement for the side sleeper to assume the fetal position without any discomforting resistance by the pillow's extension. Whereas, as opposed to the pillows of the prior art which have a right angle (90 degrees) at this location and do not resemble the contour of the side sleeper's upper body, the obtuse angle is an overly exaggerated conformity to the shoulder and immediately provides head support to the area of the lower jaw when the head is bowed forward. Also, in the pillows of the prior art, the right angle to the normal pillow width creates an uncomfortable structural resistance to the side sleeper's forward movement into the fetal position.

As the inventor, for reasons of safety, I advise the traveller to be cautious about using this invention for resting or sleeping while leaning against the locked door of any vehicle. A traveller should consult the manufacturer regarding safety while leaning against the vehicle door.

The pillow without the extension 22 will allow the head of the side sleeper to move downwardly, bringing the nose, chin and one cheek in contact with the bed. This position can place an undesirable strain on the neck which can result in immediate or delayed pain. This potential discomfort can be substantially eliminated through the use of the side sleeper's pillow 10 of the invention.

Figure 5:
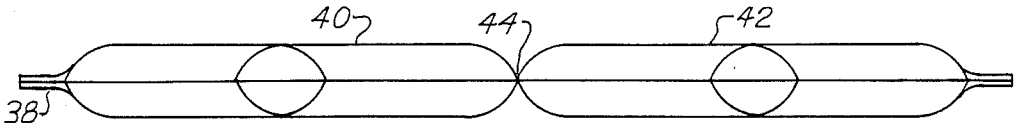
FIG. 5 is a partially broken away elevational view of the combined sleeper's pillows and pillow cases of FIG. 4, taken in the direction of arrow 5 in FIG. 4.
Figure 6:
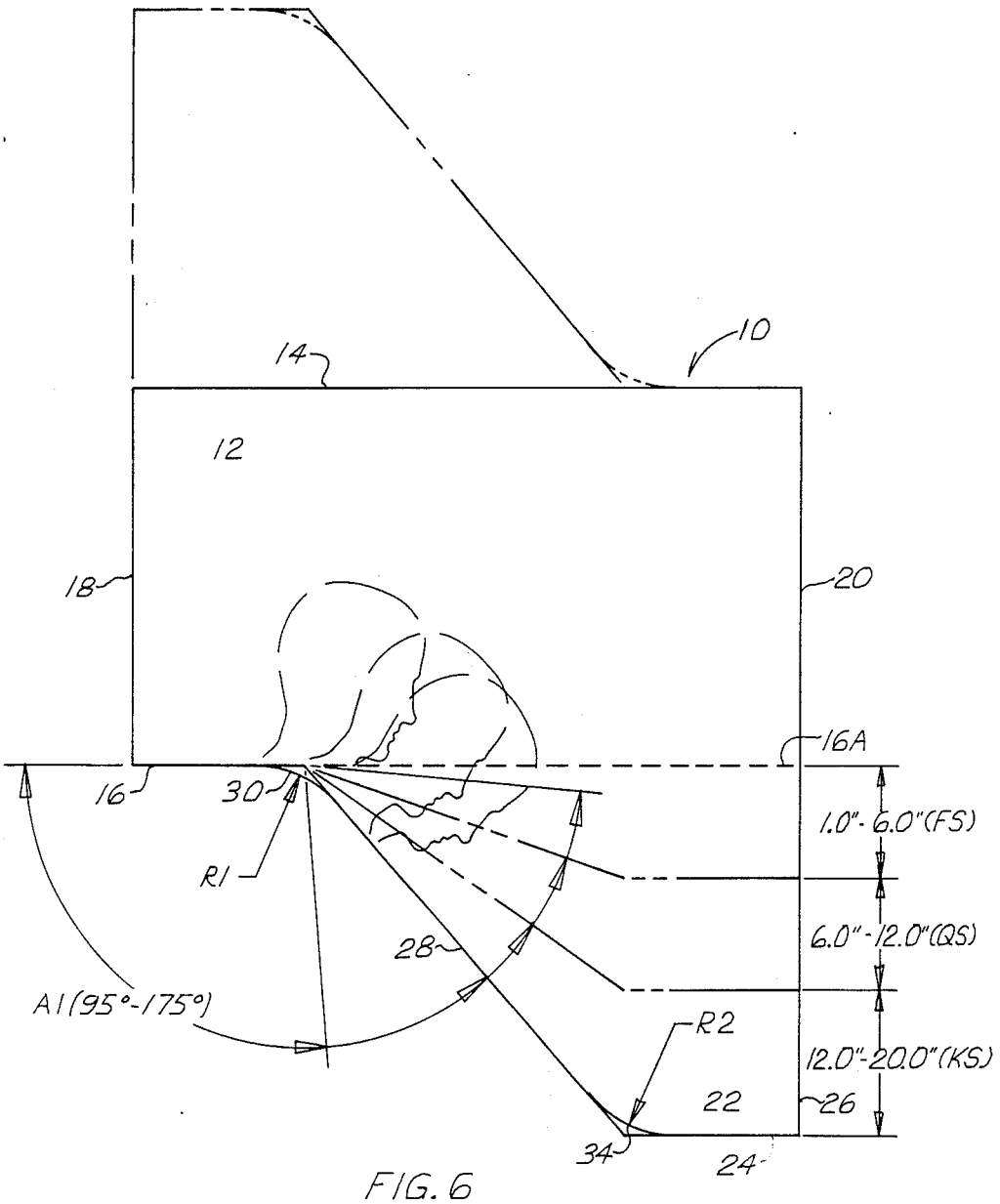
FIG. 6 is a view similar to FIG. 1 illustrating various configurations of the pillow of the invention.

The side sleeper's pillow 10 of the invention is intended to be utilized with a pillow case conforming generally to the configuration of the pillow 10. The particular pillow case 38 shown in FIG. 5 is a double pillow case having separate sides 40 and 42. The separate sides 40 and 42 are secured together by stitching 44 centrally thereof, and are open at the ends 46 and 48. The pillow case 38 is thus constructed to receive a separate side sleeper's pillow in each end thereof with the extension 22 of the side sleeper's pillow as shown in FIG. 1 at the opposite ends of the pillow case 38.

As will be understood by those in the art, the side sleeper's pillows 10 are constructed of a cloth or cloth-like outer layer and are filled with soft material, such as feathers, feather substitutes, soft plastic, air, water or the like in accordance with the usual pillow construction. Further, the pillow cases such as pillow case 38 are adapted to be constructed of any usual material, such as cloth having appropriate colors and/or designs thereon.

If desired, the pillow case may be dispensed with and the side sleeper's pillow 10 covered in suitable material adapted to be exposed in use in the manner of the well-known throw pillows used on couches and the like.

On the conventional rectangular pillow, when a sleeper's head moves forward as described above, the side facial area of the head can move off of the pillow's edge. In the angular side sleeper's pillow, the extended portion provides added support to the head as the sleeper assumes varying degrees of the fetal position.

While different embodiments of the present invention have been considered in detail, it will be understood that other embodiments and modifications thereof are contemplated by the inventor. Thus, for example, pillow cases similar to pillow case 38 may be constructed to include side sleeper's pillows 10 wherein either one or both of the extensions 22 are centrally located. It is the intention to include all embodiments and modifications of the invention as are defined by the appended claims within the scope of the invention.

What is claimed is:

1. A side sleeper's pillow comprising: a larger, generally rectangular main pillow portion having an upper edge and a lower edge in parallel, transversely spaced apart relation, and generally parallel, transversely spaced part side edges, extending between the upper and lower edges of the main pillow portion, and an extension pillow portion extending from the lower edge of the main pillow portion adjacent one side edge of the main pillow portion having a lower edge, generally parallel to the upper edge of the main pillow portion, one side edge of which is a continuation of the one side edge of the main pillow portion and a transition side edge in spaced relation to the first side edge of the extension pillow portion having segment portions at each end thereof blending smoothly into the bottom edge of the main pillow portion and the bottom edge of the extension pillow portion, wherein the segment portion of the transition side edge of the extension pillow portion blending into the lower edge of the main pillow portion at an obtuse angle and has a radius in the range of one to ten inches, and wherein the segment portion of the transition side edge of the extension pillow portion blending into the lower edge of the extension pillow portion has a radius in the range of one to twelve inches.

2. The structure as set forth in claim 1 and further comprising a second side sleeper's pillow substantially the same as the side sleeper's pillow claimed in claim 1, and a pillow case for covering both sleeper's pillows which pillow case is secured together centrally so as to provide separate compartments for each sleeper's pillow and having open outer ends for receiving the separate side sleeper's pillows.

3. The structure as set forth in claim 2 wherein the side sleeper's pillows within the pillow case have the extension portion at the outer ends of the pillow case.

4. The structure as set forth in claim 1 including a second extension pillow portion substantially the same as the extension pillow portion of claim 1 extending from the upper edge of the main pillow portion adjacent the opposite side edge of the main pillow portion.

5. A side sleeper's pillow case having top and bottom interconnected layers defining a compartment therebetween for receiving and retaining a side sleeper's pillow, each of said layers comprising: a larger, generally rectangular main pillow portion having an upper edge and a lower edge in parallel, transversely spaced apart relation, and generally parallel, transversely spaced apart side edges extending between the upper and lower edges of the main pillow portion, and an extension pillow portion extending from the lower edge of the main pillow portion adjacent one side edge of the main pillow portion having a lower edge, generally parallel to the upper edge of the main pillow portion, one side edge of which is a continuation of the one side edge of the main pillow portion and a transition side edge in spaced relation to the first side edge of the extension pillow portion have reversely curved segment portions at each end thereof blending smoothly into the bottom edge of the main pillow portion and the bottom edge of the extension pillow portion, wherein the circular segment portion of the transition side edge of the extension pillow portion blending into the lower edge of the main pillow portion at an obtuse angle has a radius in the range of one to nine inches, and wherein the segment portion of the transition side edge of the extension pillow portion blending into the lower edge of the extension pillow portion has a radius in the range of one to twelve inches.

6. The structure as set forth in claim 5 further comprising a second side sleeper's pillow case substantially the same as the side sleeper's pillow case claimed in claim 5 and secured together centrally so as to provide separate compartments.

* * * * *